United States Patent [19]

Foti

[11] Patent Number: 4,488,387

[45] Date of Patent: Dec. 18, 1984

[54] SLIDING DOOR WEATHER-SEALING DEVICE AND ASSEMBLY

[76] Inventor: Frederick A. Foti, 1352 Albany St., Apt. C, Schenectady, N.Y. 12304

[21] Appl. No.: 470,056

[22] Filed: Feb. 28, 1983

[51] Int. Cl.[3] ..... E06B 1/04

[52] U.S. Cl. ..... 52/207; 49/425; 49/493

[58] Field of Search ..... 49/425, 404, 493, 485, 49/482, 471; 52/207

[56] References Cited

U.S. PATENT DOCUMENTS

| | | | |
|---|---|---|---|
| 2,040,133 | 5/1936 | Harnly | 49/493 X |
| 2,913,046 | 11/1959 | Sharp et al. | 49/425 X |
| 2,970,642 | 2/1961 | Parsons | 49/485 X |
| 3,248,822 | 5/1966 | Sincock | 49/425 |

*Primary Examiner*—Philip C. Kannan

*Attorney, Agent, or Firm*—Heslin, Watts & Rothenberg

[57] ABSTRACT

A sliding door assembly is secured against intruders and sealed against air leakage and dust penetration by a device universally applicable to sliding door structures which is rigid, generally channel-shaped and fixedly securable to the door frame between a stationary door and a jamb and has a flange carrying a weather sealing strip in contact with the sliding door.

2 Claims, 4 Drawing Figures

SLIDING DOOR WEATHER-SEALING DEVICE AND ASSEMBLY

FIELD OF THE INVENTION

This invention relates generally to the weather sealing art and is more particularly concerned with a novel device providing both security and weather tightness in sliding door installations.

BACKGROUND OF THE INVENTION

Door structures including one or more horizontally or laterally movable doors are widely used, particularly for outdoor access in residential contruction, hotels and motels. These structures are commonly in the form of units comprising frames and doors fitted to them for preassembly or for assembly on site after the frames have been secured in place in buildings. The doors and frames are usually fabricated of aluminum but sometimes are made of other metal or wood and generally include two glass panel doors, one of which is mounted in a stationary position while the other is laterally movable in the frame. These movable doors, whether of the sliding or rolling type and whether suspended from above or supported below, are referred to herein and in the appended claims as "sliding doors".

While the stationary doors of such structures are readily securable weather tightly in their frames, the sliding doors pose a sealing problem which has long persisted in spite of determined efforts of others skilled in the art to provide a satisfactory solution. In accordance with one such prior attempt, for instance, a second sliding door assembly is used as a sort of storm door so that the wind cannot below directly against the inner door assembly and through the spaces between the sliding door thereof and its frame and supporting structure. This expensive measure even so does not prevent cold air from entering through the open spaces in the two assemblies, there being no seal provided by the second assembly to prevent it.

Another attempt at solving the problem involved the application of a plastic sheet to the inside of the sliding door assembly. The sheet is hung over the assembly in the heating season to keep out cold air, but then it is removed in the warm season so that the sliding door can be used. In addition to the nuisance of attaching and removing the sheet at intervals, this approach has the important disadvantage that it does not solve the problem of dirt and dust penetration into the house through the assembly when the sheet cover is down so the sliding door can be used.

SUMMARY OF THE INVENTION

I have found that the shortcoming of the prior art can be avoided and important new advantages can be obtained by approaching this old problem in a new way. In particular, I have discovered that it is possible to accomplish the weather sealing results by means applicable universally to all common standard sliding door styles and types, both in the course of manufacturing and in the retrofitting of existing installations. Further, the new device of my invention embodying this novel means concept of mine is both economical to produce and simple and easy to install. It is also readily removable for cleaning purposes and for replacement of the sealing strips should that become necessary. Still further, this device requires no modification of the design or special construction of the doors or of the frame or of any part of the sliding door structure. Moreover, the new device serves an important security purpose in all such cases by providing a positive locking action against an intruder who would attempt entry through a sliding door assembly by jimmying the stationary door which is normally only superficially attached to the lockable sliding door.

In essence, my invention centers on the novel concept of accomplishing sliding door sealing with a device in the form of a rigid element carrying a flexible, non-binding, sealing strip; the element being universally applicable to sliding door structures to which it can be readily secured, but removably attached, to provide the desired sealing effect without interfering in the use or operation of the sliding door. As indicated above, this new device secured in place in assembly with a sliding door structure serves the other important purpose of providing security against would-be intruders seeking access to dwellings through otherwise vulnerable sliding door structures. Both of these important purposes can be served by this novel device made of either metal or plastic material which has requisite physical properties of strength and rigidity such as to be alternative to metal for this use.

Briefly described, then, the device of this invention comprises an elongated, rigid, generally channel-shaped body having a lateral flange extending substantially its full length and a recess formed in the free edge of the flange extending its full length and opening away from the body, and a sealing strip of non-binding, deformable, non-metallic material disposed in the recess and projecting therefrom over substantially the full length of the body for weather-sealing engagement with the sliding door surface.

Likewise described in brief, the sliding door assembly of this invention comprises a door frame including a head, a sill having a rail, and jambs joining the ends of the head and sill providing therewith a generally rectangular, upright, door containment structure, a pair of doors mounted in the frame, one of which is fitted with rollers engaging the sill rail for lateral motion of the door relative to the frame and the other door. Further, the assembly includes a door sealing and securing device comprising a rigid, elongated, generally channel-shaped body as described in the paragraph just above.

BRIEF DESCRIPTION OF THE DRAWINGS

Those skilled in the art will gain a further and better understanding of this invention upon consideration of the detailed description set forth below of the preferred embodiments illustrated in the drawings accompanying and forming a part of this specification, in which.

DETAILED DESCRIPTION OF THE DRAWINGS

Figure 1:
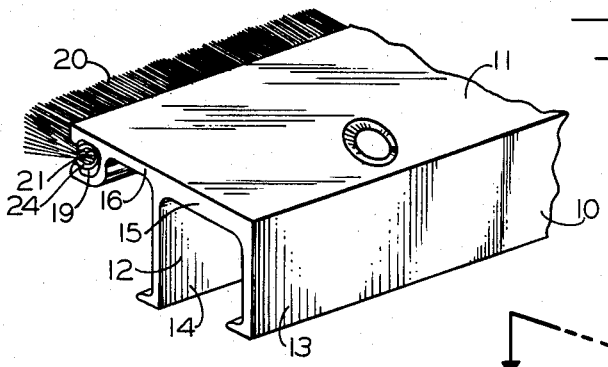
FIG. 1 is a view in perspective of a sliding door sealing and securing device.

As shown in FIG. 1, sliding door sealing and securing device 10 comprises an elongated body 11 in the form of an aluminum extrusion generally channel-shaped in cross-section. Channel 12 of the body is defined by a first wall 13, a second slightly higher wall 14 parallel and spaced from wall 13 and a top or closed side wall 15 which bridges between and is coextensive with walls 13 and 14. A flange 16 in the nature of a lateral extension of wall 15 projects from one side of the channel portion of the body and has a recess 19 in the form of a reentrant cavity formed in its free edge opening away from the channel portion and extending the full length of the flange. A sealing strip 20 of plastic-bound mohair is carried by body 11, bead portion 21 of the plastic binder 24 being received and securely retained within flange recess 19 so that mohair attached as a plurality of tufts to the binder 24 projects as a continuous strip from body 11 for weather sealing and dust sealing, non-scoring and non-binding contact with the surface of a sliding door. Mohair strip 20 is directed slightly upwardly for contact with a sliding door as a result of the sloping attitude of flange 16 which facilitates drainage of rain water away from the sliding door when device 10 is located in usual manner on the outside of a sliding door structure.

Figure 2:
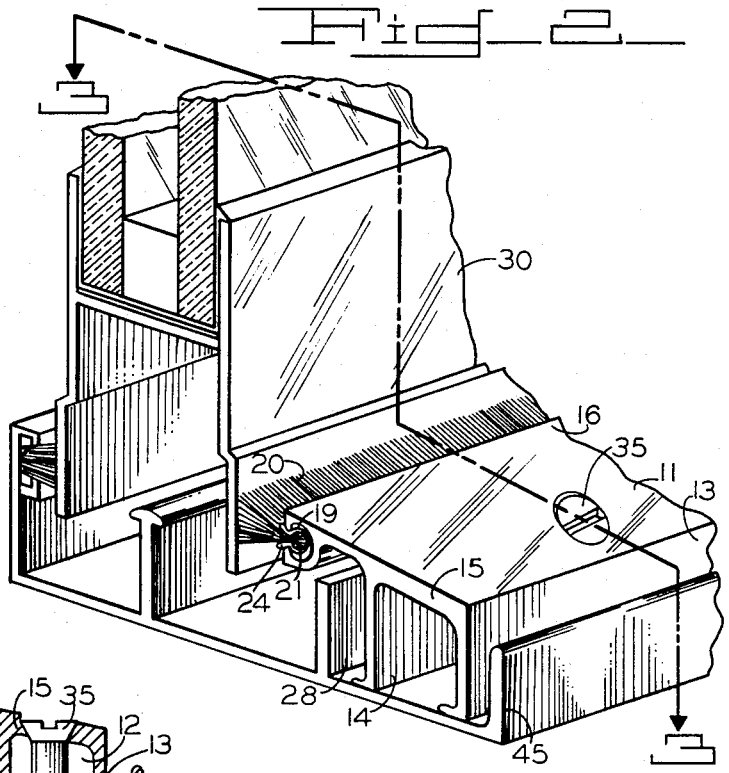
FIG. 2 is a fragmentary perspective view of a sliding door assembly incorporating the device of FIG. 1.
Figure 3:
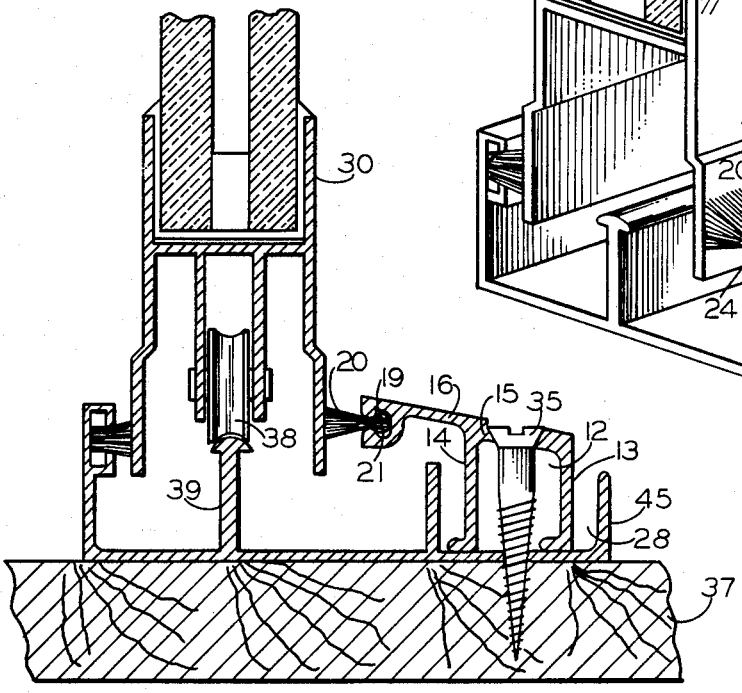
FIG. 3 is a cross-sectional view of the assembly of FIG. 2 taken on line 3—3 thereof.

In regard to FIGS. 2 and 3, the device of FIG. 1 in typical assembly with a sliding door structure is disposed in a sill channel 28 so that its walls 13 and 14 rest on the bottom of sill 29 and flange 16 is directed slightly upwardly toward sliding door 30 so that mohair strip 20 bears against it but does not substantially impede lateral motion of the door. Body 11 is secured in place in this position by suitable fastening means, preferably removable means such as screw 35 shown in these drawings as being tapped into the bottom of the sill and wooden structural member 37. Door 30 is supported on rollers 38 (one shown) which run on rail 39 which is integrally formed with sill 29.

Figure 4:
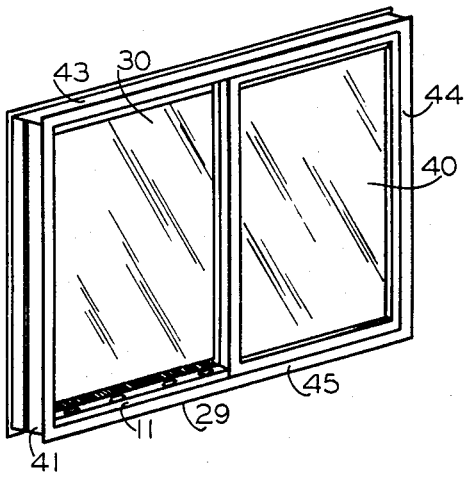
FIG. 4 is an elevational view of the assembly of FIGS. 2 and 3 showing the invention device in place securing the stationary door against movement in the door frame.

As shown in FIG. 4, body 11 bridges the space between stationary door 40 and jamb 41 of the door frame which includes head 43 and jamb 44 in addition to jamb 41 and sill 29 which is joined at its ends to the ends of head 43 by the two jambs. Sill 29 has an outer flange 45 spaced from body 11, as evident in FIGS. 2 and 3, which serves as a rail support for a sliding screen (not shown). With body 11 secured in position with its ends bearing against door 40 and jamb 41 and its mohair strip 20 bearing over its full length against sliding door 30 in closed position, the assembly is weather tightly sealed and also locked against access by anyone who would attempt to move stationary door 40 from its position secured by body 11 and its fastening means.

What is claimed:

1. A sliding door assembly incorporating combination securing and weather sealing means said assembly comprising:

(1) a door frame including:

(a) a head, (b) a sill having an inner flange and an outer flange to support a sliding screen and a door-supporting rail between and spaced from said inner and outer flanges, and (c) jambs joining the ends of the head and sill and providing therewith a generally rectangular upright door containment structure;

(2) a first stationary door mounted in the frame and a second door supported on rollers engaging the said sill rail for lateral motion of the second door in the frame; and, (3) a weather sealing and securing device comprising an elongated rigid generally channel-shaped body disposed and secured in place in the door frame sill between the sill rail and the outer flange and spaced from said outer flange with one end of the said body bearing against the first stationary door and the other end bearing against the opposed jamb of the door frame whereby said first door is locked in place in the door frame, said body having a lateral flange extending toward the inner flange of the sill substantially the full length of the body and a reentrant cavity formed in and extending the full length of the free edge of the flange, and said weather sealing and securing device including in addition a sealing strip of non-binding deformable non-metallic material disposed in said reentrant cavity and projecting therefrom over substantially the full length of the body for weather sealing engagement with the second door surface.

2. The sliding door assembly of claim 1 in which the sill has an upstanding rib between the outer flange and the door-supporting rail providing a sill channel, and in which the body of the weather sealing and securing device bears against the sill within the said sill channel, and in which the lateral flange of the body of the said device is sloped downwardly away from the second door in the direction of the door frame outer flange to facilitate drainage of rainwater away from the said second door.

* * * * *